United States Patent [19]

Klusmier

[11] 4,419,928

[45] Dec. 13, 1983

[54] BUNDLING AND STACKING APPARATUS

[75] Inventor: Kenneth L. Klusmier, Worcester, Mass.

[73] Assignee: Morgan Construction Company, Worcester, Mass.

[21] Appl. No.: 378,837

[22] Filed: May 17, 1982

[51] Int. Cl.[3] ..... B65B 13/18

[52] U.S. Cl. ..... 100/7; 100/14; 100/26; 414/30; 414/74

[58] Field of Search ..... 100/7, 14, 26; 414/30, 414/91, 56, 74

[56] References Cited

U.S. PATENT DOCUMENTS

| | | | |
|---|---|---|---|
| 2,559,460 | 7/1951 | Peterson | 414/30 X |
| 2,596,862 | 5/1952 | Mirfield | 100/7 |
| 3,127,829 | 4/1964 | Rossi | 100/7 X |
| 3,427,958 | 2/1969 | Glasson | 100/7 |
| 3,427,959 | 2/1969 | Keil | 100/7 X |
| 3,452,884 | 7/1969 | Tanqueray | 414/30 |
| 3,497,084 | 2/1970 | Murrah | 100/7 X |
| 3,837,465 | 9/1974 | Klusmier et al. | 100/7 X |
| 3,880,070 | 4/1975 | Kaplan | 100/7 |
| 3,956,982 | 5/1976 | Hill et al. | 100/7 X |
| 3,957,163 | 5/1976 | Tanzler | 414/30 |
| 4,003,189 | 1/1977 | Little et al. | 100/7 X |
| 4,109,801 | 8/1978 | Uchida | 414/56 |
| 4,120,406 | 10/1978 | Durnig | 100/7 X |
| 4,174,662 | 11/1979 | Klusmier | 100/7 |
| 4,278,377 | 7/1981 | Elineau | 414/30 |

FOREIGN PATENT DOCUMENTS

| | | | |
|---|---|---|---|
| 2600856 | 7/1977 | Fed. Rep. of Germany | 414/30 |
| 2731579 | 1/1979 | Fed. Rep. of Germany | 414/30 |

*Primary Examiner*—Billy J. Wilhite

*Attorney, Agent, or Firm*—Thompson, Birch, Gauthier & Samuels

[57] ABSTRACT

A material handling apparatus has a first operational mode for bundling elongated elements having round cross-sectional profiles, and a second operational mode for stacking elongated elements having shaped flat-sided cross-sectional profiles.

13 Claims, 21 Drawing Figures

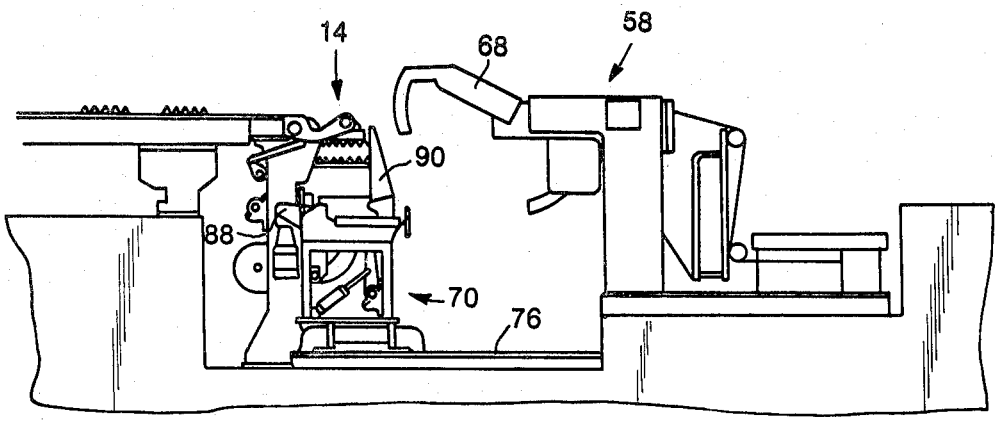
FIG.IOD
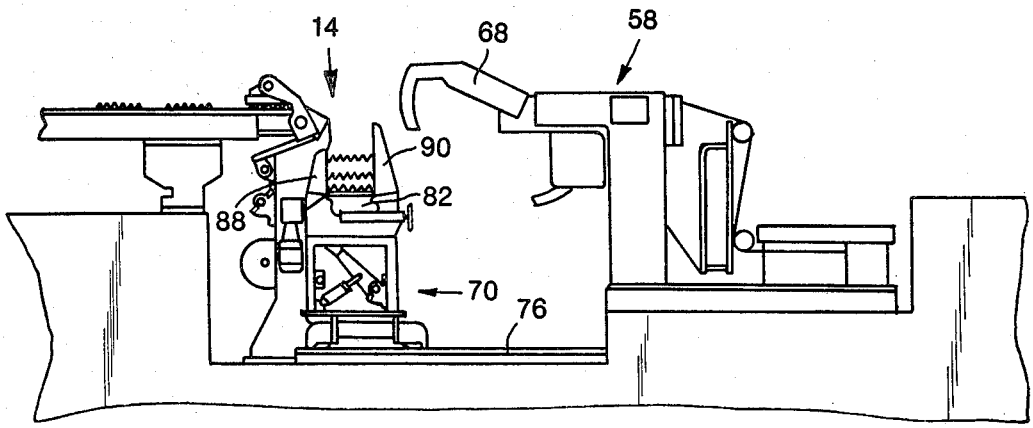
FIG.IOE
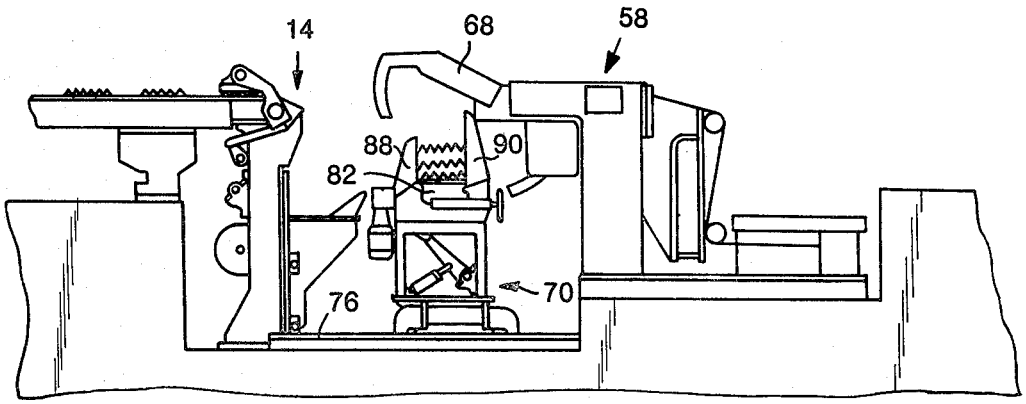
FIG.IOF

BUNDLING AND STACKING APPARATUS

BACKGROUND OF THE INVENTION

1. Field of the Invention

This invention relates to the art of material handling, and is concerned in particular with an apparatus which has the capability of bundling product lengths having round cross-sectional profiles, such as steel bars, rods, pipes, etc., and which also has the capability of stacking product lengths having shaped flat-sided cross-sectional profiles such as flats, angles, channels and the like.

2. Description of the Prior Art

Numerous arrangement have developed specifically for handling and/or bundling products with round cross-sectional profiles (commonly referred to as "rounds"). Examples of these arrangements are shown in U.S. Pat. Nos. 2,596,862 (Mirfield); 2,905,340 (Clark et al); 3,045,846 (Clark); 3,055,515 (Harbkersman); 3,127,829 (Rossi); 3,427,958 (Glasson); 3,427,959 (Keil); 3,497,084 (Murrak); 2,352,623 (Gaumer); 3,837,465 (Klusmier); 3,871,533 (Mulcahy et al); 3,950,920 (Thomsen et al); 3,956,982 (Hill et al); 4,003,189 (Little et al); 4,120,406 (Durnig) and 4,174,662 (Klusmier). However, such arrangements do not have the capability of also handling product lengths with shaped flat-sided cross-sectional profiles (commonly referred to a "shapes"). Shapes are handled by different types of equipment, examples of which are shown in U.S. Pat. Nos. 2,559,460 (Peterson); 3,347,397 (Hein); 3,422,968 (Martin); 3,452,884 (Tangueray); 3,627,099 (Shaffer); 3,749,256 (Hill); 3,880,273 (Kaplan); 3,920,132 (Cleland et al); 3,957,163 (Tanzler); 4,109,801 (Uchide et al); 4,278,377 (Elineau); and German Aus. 1183020 (Tanzler).

If a mill is producing only one type of product, i.e., either shapes or rounds, then only one type of conventional product handling equipment need be installed. However, many mills are designed to produce both rounds and shapes, thus necessitating the installation of two separate product handling systems, one for each type of product. Such systems occupy large mill areas, and they are also costly to install and expensive to operate and maintain.

SUMMARY OF THE PRESENT INVENTION

A primary objective of the present invention is the provision of an improved material handling appartus having the capability of handling both rounds and shapes, thus eliminating the necessity to resort to dual product handling systems in mills designed to roll both types of product.

In a preferred embodiment of the invention to be described hereinafter in more detail, a conveyor is arranged to receive and laterally transport either rounds or shapes in side-by-side relationship to a bundling and stacking station. A vertically adjustable elevator is located at this station. When handling rounds, a first transfer mechanism operates to transfer the rounds from the conveyor delivery end onto the elevator. Stationary members cooperate with movable members to laterally confine the rounds as they accumulate in bundle form on the elevator. The elevator is gradually lowered to accommodate the continuing deposit of rounds thereon. The movable members are adjustable to inoperative positions, either to accommodate lateral removal of a completed bundle of rounds from the conveyor, or in order to switch the operational capability of the apparatus from rounds to shapes.

When handling shapes, a second transfer mechanism is used in place of the first transfer mechanism to transfer layers of shapes from the conveyor onto the elevator, the latter again being lowered gradually to accommodate successive layers.

Preferably, the second transfer mechanism includes pivotal magnet members which can be operated to invert selected product layers, thereby establishing an interlocking relationship which improves the structural integrity of the stack.

Preferably, the apparatus also will include a tieing device on the side of the bundling and stacking station opposite to that occupied by the conveyor. A carriage assembly is employed to laterally transfer either bundles of rounds or stacks of shapes from the elevator at the bundling and stacking station to the tieing device, which then operates to tie either the bundles or stacks into integral units.

Preferably, the carriage assembly will include confining members for laterally confining the rounds during transit from the bundling and stacking station to the tieing device, as well as means for removing the bundles or stacks longitudinally therefrom after they have been tied into integral units.

BRIEF DESCRIPTION OF THE DRAWINGS

FIGS. 10A–10F are schematic illustrations again showing sequential operational stages of the apparatus during the handling of shapes.

DESCRIPTION OF PREFERRED EMBODIMENT

Referring initially to FIGS. 1 to 7, an apparatus in accordance with the present invention is shown comprising a chain conveyor 10 of generally conventional design having endless chains 12 running between drive and driven sprockets (not shown). The upper runs of the chains 12 move from left to right as viewed for example in FIGS. 1 and 2 to thereby provide a means of laterally transporting either shapes "S" such as the angles shown in FIG. 7 or rounds "R" such as the bars shown in FIG. 6. Such products are transferred by the conveyor to a bundling and stacking station generally indicated at 14.

Figure 4:
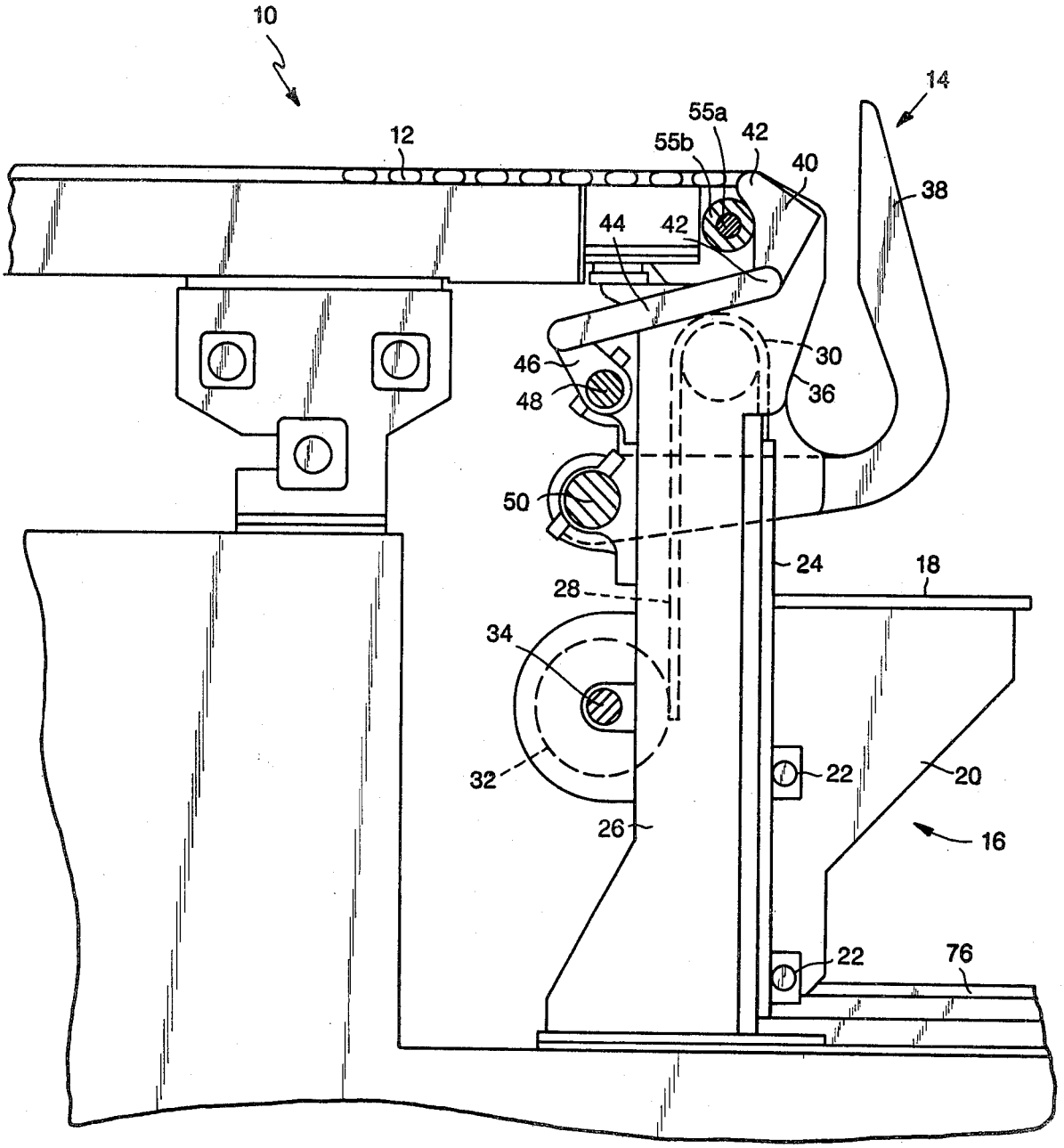
FIG. 4 is a sectional view taken along line 4—4 of FIG. 2 showing the components at the bundling and stacking station at a preliminary stage in the handling of rounds.
Figure 5:
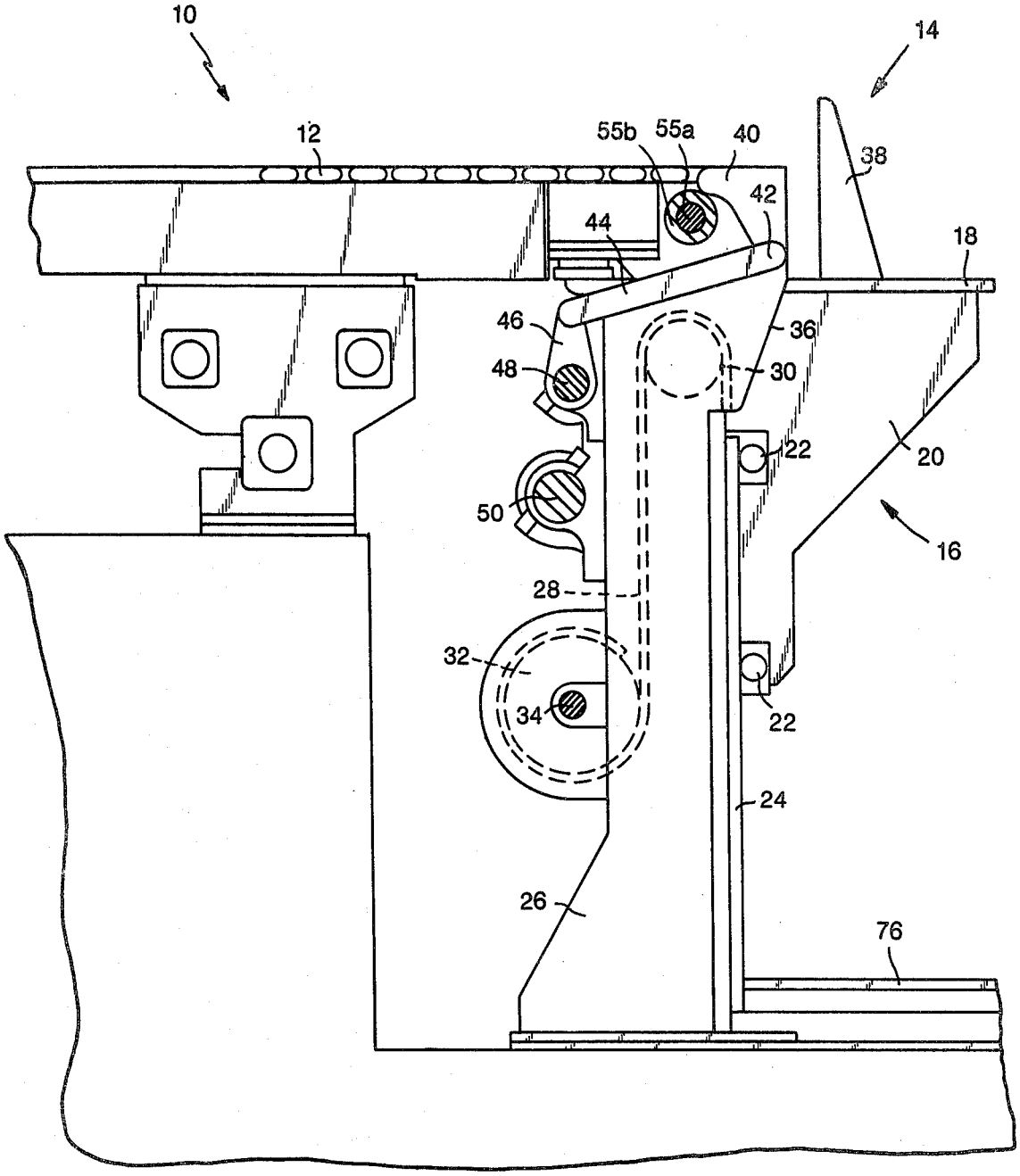
FIG. 5 is a view similar to FIG. 4 showing a subsequent operational stage during the handling of rounds.
Figure 7:
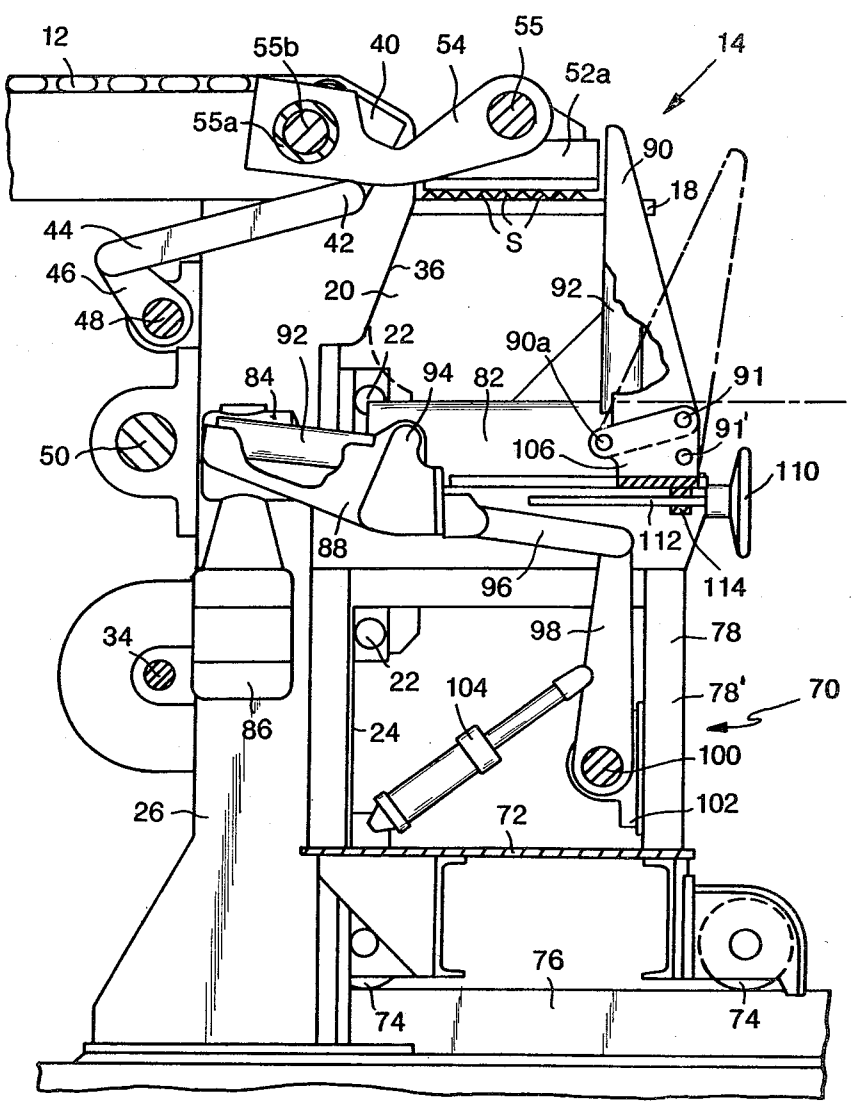
FIG. 7 is a view similar to FIGS. 4–6, but showing an operational stage during the handling of shapes.

Elevator units 16 are located at the bundling and stacking station 14. Each elevator unit has a horizontal support surface 18, and a depending carriage section 20 having guide wheels 22 arranged to run along vertical tracks 24. The tracks are secured to pedestals 26 supporting the delivery end of the conveyor 10. As shown in FIGS. 4 and 5, each elevator unit is vertically adjusted by a chain 28 running over an idler sprocket 30 to a driven sprocket 32. The driven sprockets 32 of the elevator units are keyed to a common shaft 34 which is rotatably driven in either the clockwise or counterclockwise direction by conventional means (not shown).

As can best be seen in FIGS. 4 and 5, the upper portions of the pedestals 26 define stationary members 36 which cooperate with movable members 38 to receive and confine rounds therebetween being dropped from the delivery end of the conveyor 10 onto the support surfaces 18 of the elevator units 16.

As can be best seen in FIGS. 4 and 5, a first transfer means includes conveyor extensions 40 pivotally mounted at 42 for movement between raised operative positions at which their upper edges extend horizontally out from the conveyor transport surface (FIG. 5), and lowered inoperative positions (FIG. 4) in which their upper edges are below the downwardly sloping upper edges of the stationary members 36 at the upper ends of the pedestals 26. When in their raised operative positions, the conveyor extensions 40 assist in horizontally guiding rounds to a desired delivery point from which they may drop onto the support surfaces 18 of the elevator units 16. The conveyor extensions 40 are pivotally adjusted by links 44 connected to bell cranks 46. The bell cranks are keyed to a common shaft 48 which is again rotatably driven in opposite directions by conventional means (not shown).

The movable members 38 are keyed to a common shaft 50 which is also driven by conventional means (not shown) for rotation in either a clockwise or counterclockwise direction.

Figure 8A:
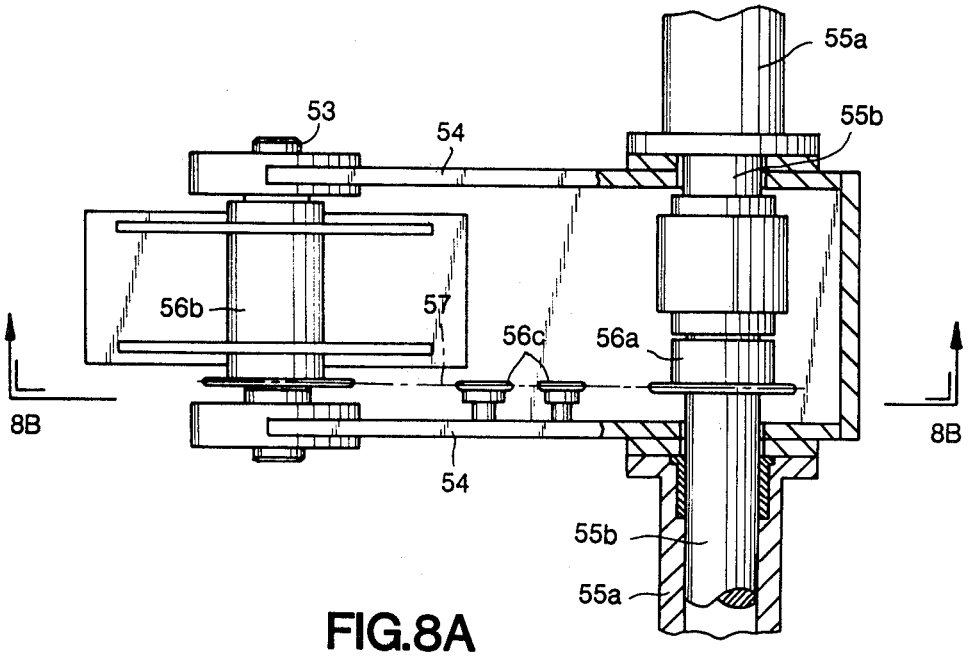
FIG. 8A is an end view of the second transfer means, with portions broken away in order to better illustrate internal components.
Figure 8B:
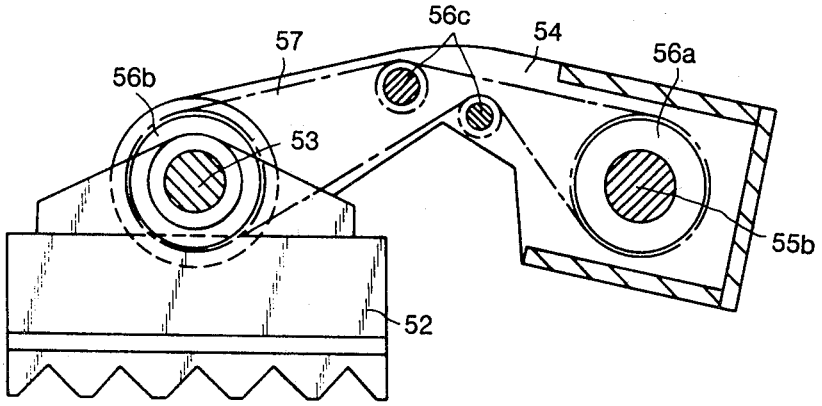
FIG. 8B is a sectional view taken along line 8B—8B of FIG. 8A.

A second transfer means includes magnets 52 used to shift layers of shapes from the delivery end of the conveyor 10 onto the elevator units 16. As can best be seen in FIGS. 8A and 8B, each magnet 52 is rotatably mounted on a short shaft 53 carried between the upper ends of a pair of arms 54. The lower ends of the arms are secured to tubular shaft sections 55*a*. Interconnected line shaft sections 55*b* extend through the tubular shaft sections 55*a*. One of the line shaft sections 55*b* carries a sprocket 56*a* which is connected mechanically to a sprocket hub 56*b* on the magnet 52 by an endless chain 57. Intermediate sprockets 56*c* maintain the chain sections extending between sprockets 56*a*, 56*b* in a desired configuration. The tubular shaft sections 55*a*, and line shaft sections 55*b* of each successive magnet are joined one to the other. Conventional means (not shown) are provided for independently rotating the tubular shaft sections 55*a* and the line shaft sections 55*b*.

Figure 10A:
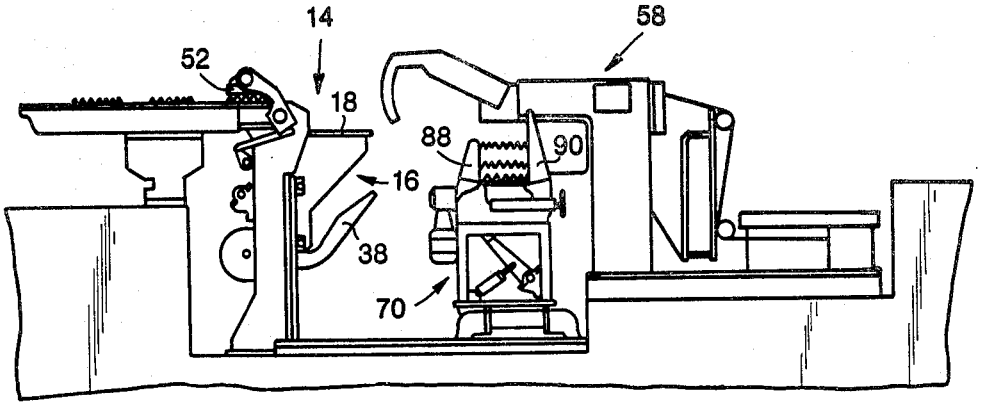
Figure 10B:
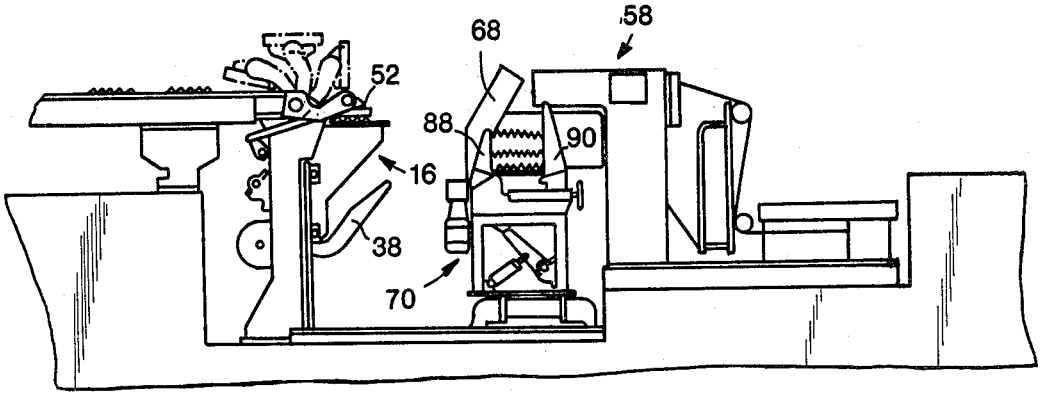
Figure 10C:
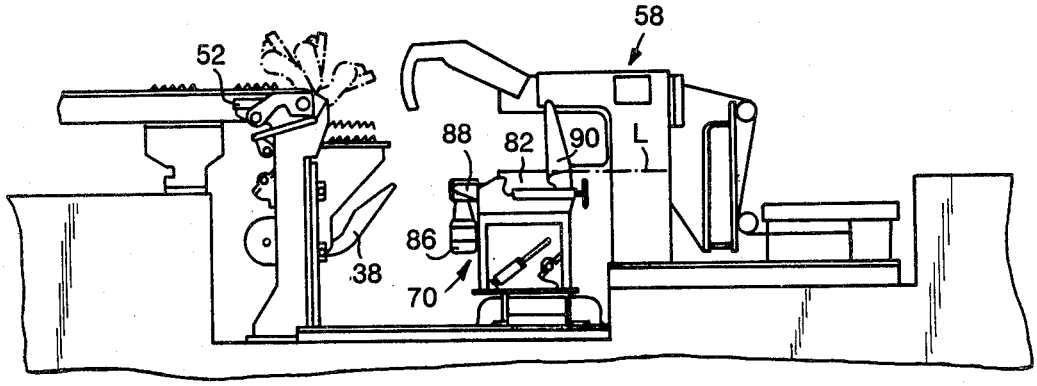

When a layer of shapes is to be transfered without being inverted, the shaft sections 55*a*, 55*b* are rotated in a controlled manner to operatively manipulate the magnets 52 as depicted schematically by the dot-dash lines in FIG. 10B. On the other hand, when a layer of shapes is to be inverted, the magnets are operatively manipulated as depicted schematically by the dot-dash lines in FIG. 10C. When the magnets 52 are not in use, for example when the apparatus is handling rounds, they are parked in inoperative positions beneath the level of the conveyor 10, as shown for example in FIG. 6.

Figure 1:
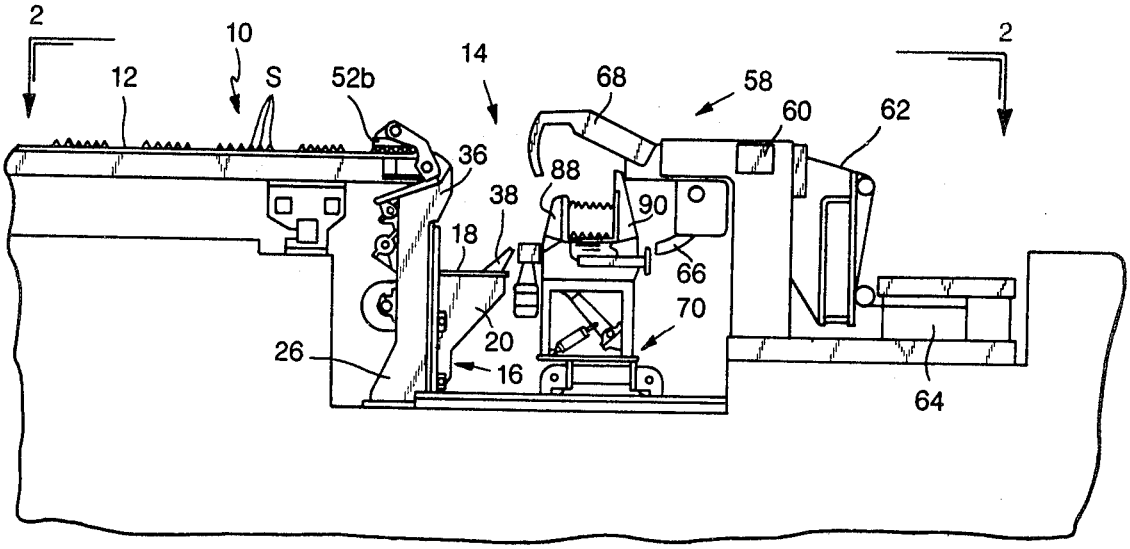
FIG. 1 is a view in side elevation of an apparatus in accordance with the present invention in its second operational mode, showing a stack of shapes, in this case angles, being transferred from the bundling and stacking station to the tieing device.
Figure 2:
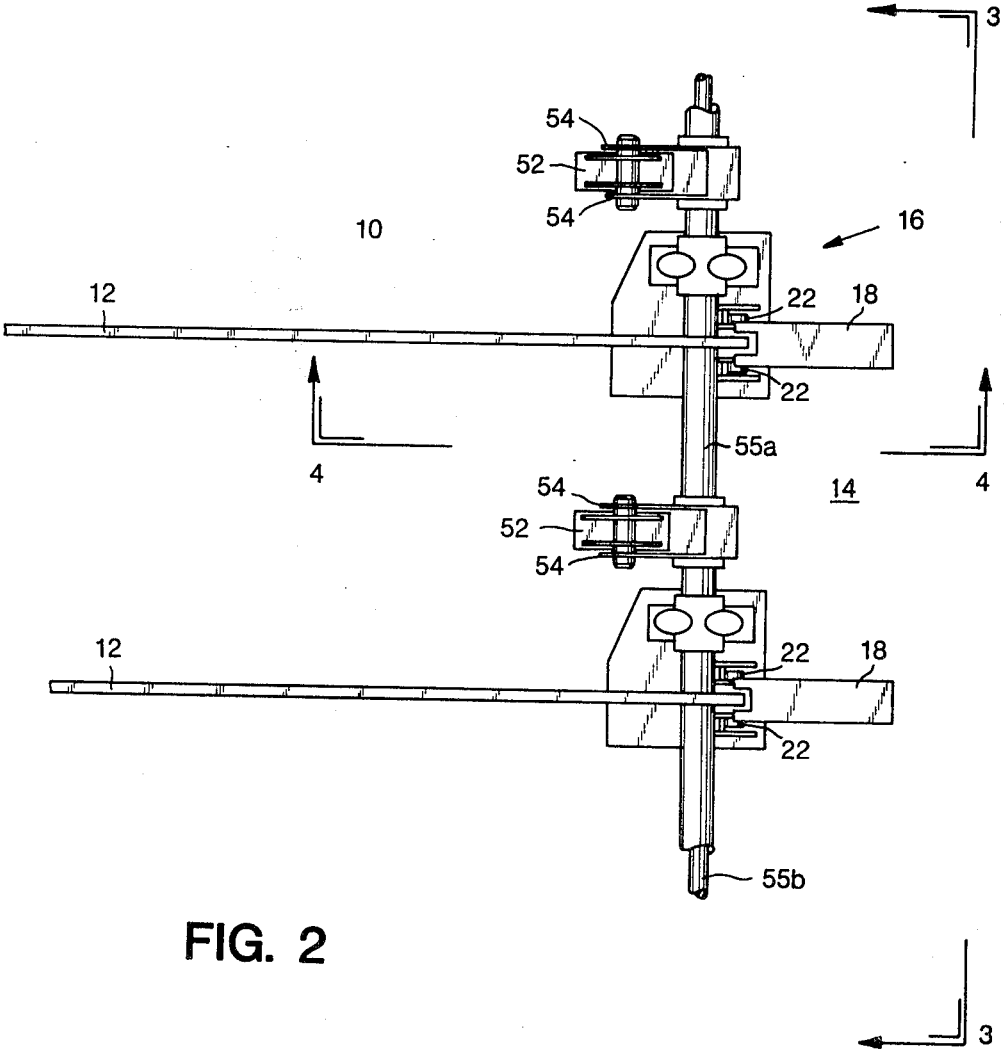
FIG. 2 is a plan view on an enlarged scale of a portion of the apparatus shown in FIG. 1.
Figure 3:
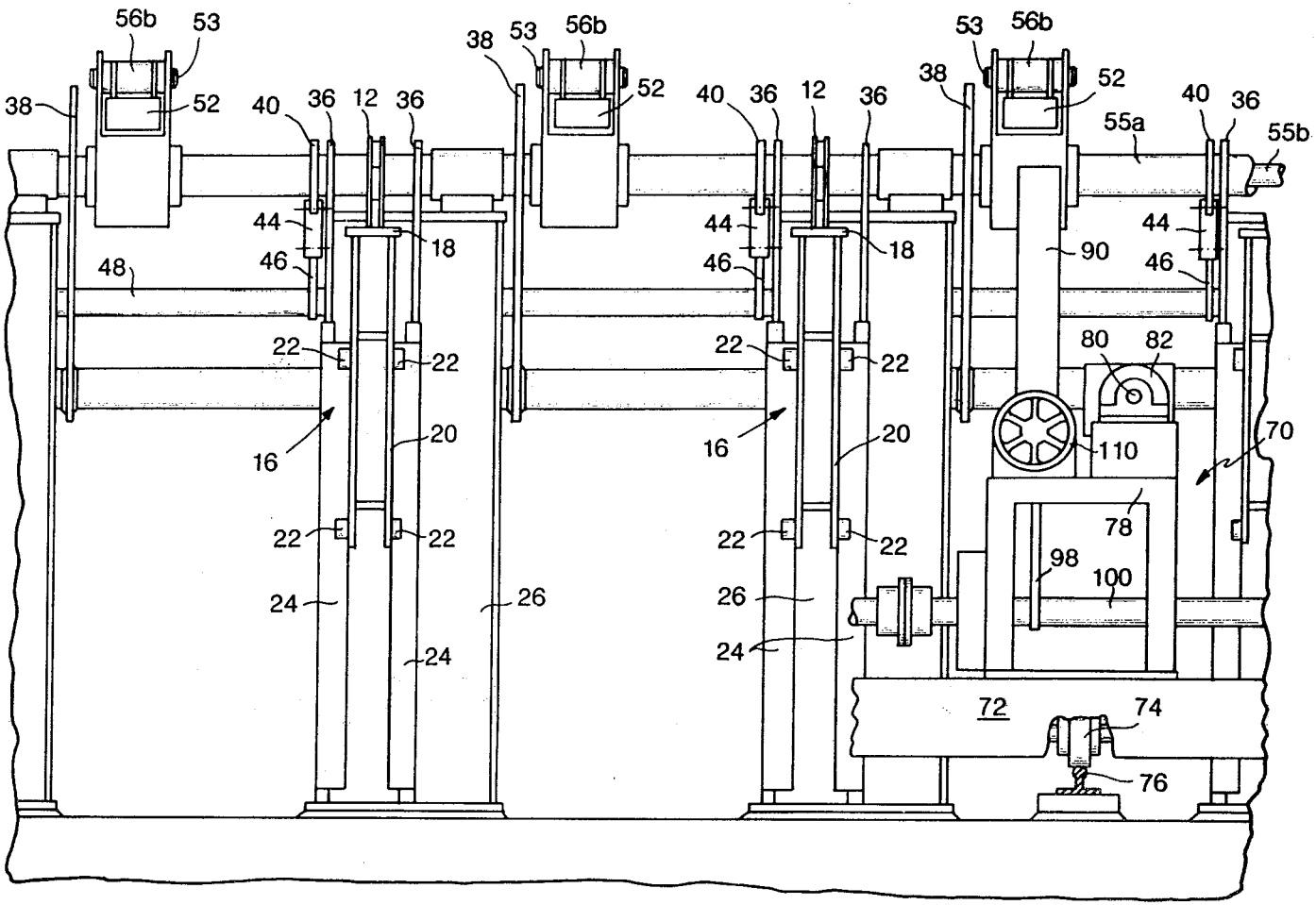
FIG. 3 is an end elevational view on an additionally enlarged scale taken substantially along line 3—3 of FIG. 2.

Returning now to FIG. 1, it will be seen that the apparatus also includes a tieing device generally indicated at 58 on the side of the bundle and stacking station 14 opposite to that occupied by the conveyor 10. The tieing device is of conventional design, with a strapping machine 60 arranged to feed strap 62 or other like tieing material from the spool 64 around a bundle or stack along a path defined by a fixed track 66 and a movable track 68. The movable track is pivotally adjustable from an open position as shown in FIG. 1 to a closed position as shown in FIG. 10B. This type of tieing device is well known to those skilled in the art, and thus further description is not required.

A carriage assembly generally indicated at 70 is arranged for lateral movement in opposite directions between the bundling and stacking station 14 and the tieing device 58. As can be seen by additional reference to FIGS. 3, 6 and 7, the carriage assembly has a longitudinally extending chassis 72 supported by means of wheels 74 for lateral movement in opposite directions along horizontal tracks 76. Pedestals 78 are spaced along the length of chassis 72. Each pedestal has bearings 80 rotatably supporting a horizontal table roller 82. Each table roller is driven through a gear box 84 by a motor 86. The table rollers 82 define a support surface at a level "L" for receiving either bundles of rounds R or stacks of shapes S from the elevator units 16 at the bundling and stacking station 14.

The carriage pedestals 78 are each provided with mutually spaced substantially opposed first and second arm members 88, 90, which extend upwardly from the support surface defined by the rollers 82. The inner surfaces of the arm members 88, 90 are defined by rollers 92 which rotate freely about their respective axis. The first arm members 88 are pivotally mounted as at 94 and are adjustable between upstanding positions as shown in FIG. 1 and inoperative positions beneath the level L as shown for example in FIGS. 6 and 7. This pivotal adjustment is achieved via links 96 connected to crank arms 98 which are in turn carried on a shaft 100 supported by bearings 102 on the pedestal legs 78'. Piston-cylinder units 104 provide the power for rotatably adjusting the crank arms 98 about the axis of shaft 100.

Figure 6:
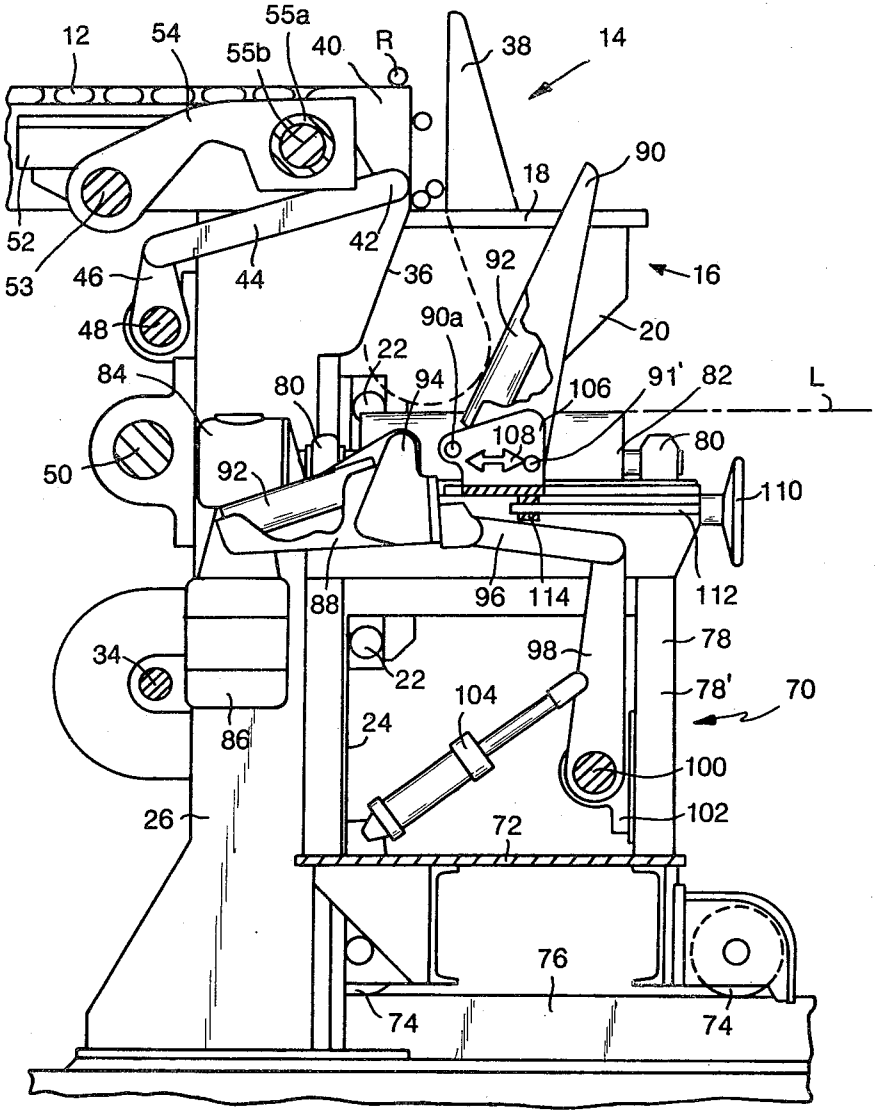
FIG. 6 is a view similar to FIGS. 4 and 5 at a still further stage during the handling of rounds.

The second arm members 90 are pivotably mounted as at 90*a* on brackets 106 which are movable in opposite directions as indicated by the arrow 108 in FIG. 6. This movement, which provides a means of adjusting the distance between the first and second arm members 88, 90 is achieved by rotating hand wheels 110 which have spindles 112 threaded through nuts 114 depending from the brackets 106. When handling stacks of shapes, the arms 90 are retained in vertical positions as shown by the solid lines in FIG. 7 by means of removable pins 91 inserted through the bases of the arms and appropriately located holes in the brackets 106. When handling rounds, the arms 90 are shifted to inclined positions as shown by the dot-dash lines in FIG. 7 and the solid lines in FIG. 6. This is accomplished by shifting the pins to alternate locations 91'.

The operation of the apparatus when bundling rounds will now be described with reference to FIGS. 9A–9F.

Figure 9A:
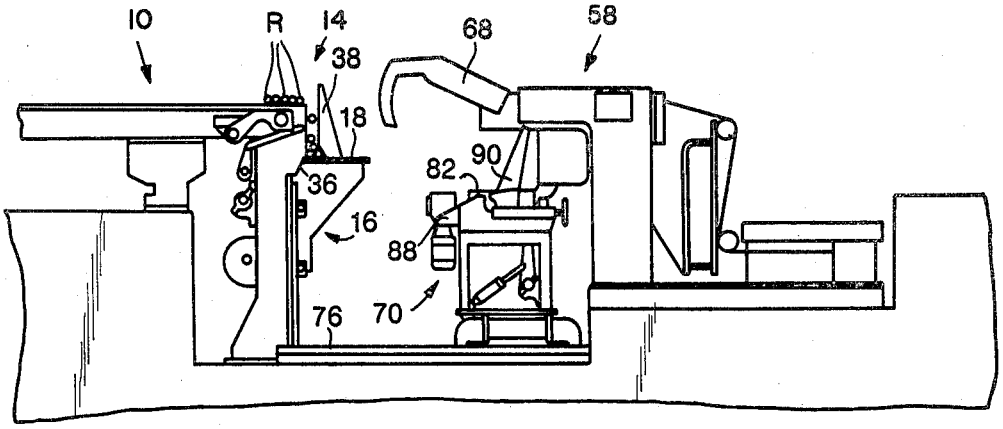
FIGS. 9A–9F are schematic illustrations showing sequential operating stages of the apparatus during the handling of rounds.

In FIG. 9A, the apparatus is shown with the elevator units 16 raised to positions such that rounds R are being received on the horizontal support surfaces 18 from the delivery end of the conveyor 10. The rounds R are confined between the stationary members 36 and the operatively positioned movable members 38. The carriage assembly 70 is at a location underlying the tieing device 58, the latter have its movable track 68 raised to an inoperative position. The first arm members 88 on the carriage assembly 70 are lowered.

Figure 9B:
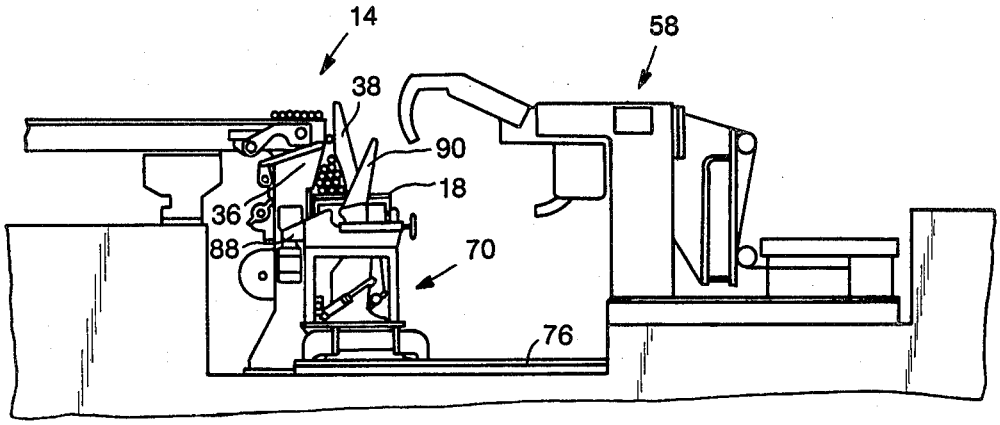
Figure 9C:
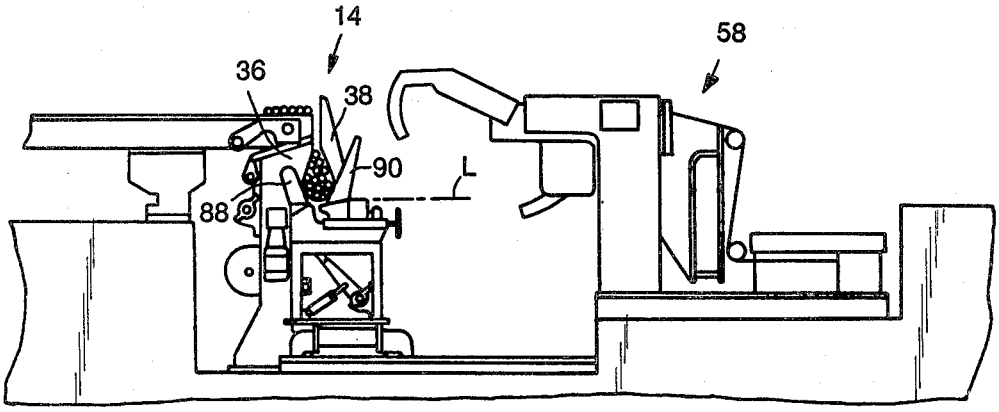
Figure 9D:
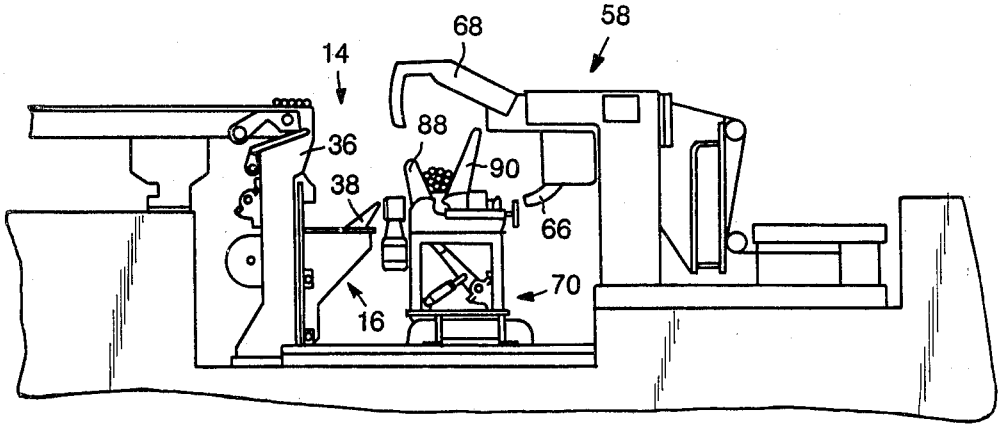

As shown in FIG. 9B, while rounds continue to accumulate on the elevator support surfaces 18 between the stationary and movable members 36, 38, the carriage assembly 70 is shifted along tracks 76 from beneath the tieing device 58 to the bundling and stacking station 14. The lowered position of the first arm members 88 enables the carriage assembly 70 to be so positioned. Thereafter, as shown in FIG. 9C, the first arm members 88 are raised to their operative positions to cooperate with the second arm members 90 in providing a receiving notch. At the completion of the bundle forming sequence, the chain conveyor 10 is momentarily stopped and the elevator units 16 are lowered beneath the level L of the table rollers 82 on the carriage assembly. Thereafter, the movable members 38 are lowered to their inoperative positions, thus transferring the bundle of accumulated rounds onto the carriage table rollers 82 in a confined position between the first and second arm members 88, 90. This having been accomplished, and as shown in FIG. 9D, the carriage assembly 70 is then shifted from the bundling and stacking station 14 back to a position underlying the tieing device 58. While this transfer is taking place, the bundle of rounds remains securely confined between the first and second arm members 88, 90.

Figure 9E:
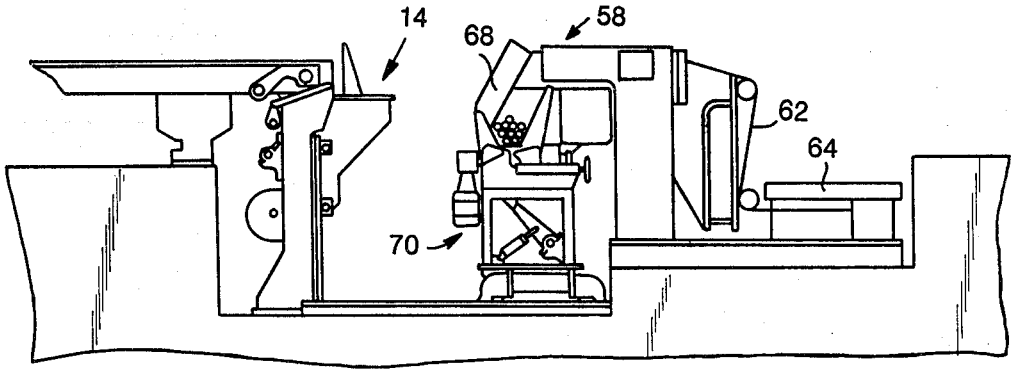
Figure 9F:
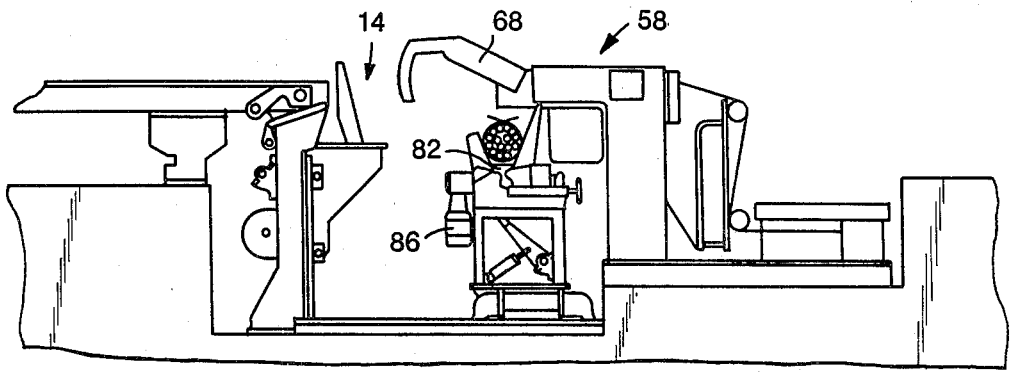

Upon arrival beneath the tieing device 58, as shown in FIG. 9E the confined bundle of rounds is then tied into an integral unit. This is accomplished by first lowering the movable track 68 of the tieing device so that its curved leg mates with the fixed track 66 to provide a continuous path around the bundle of rounds. Thereafter, the tieing device 58 cycles in a known manner to tie the bundle of rounds into an integral unit with strap material 62 withdrawn from the spool 64. Thereafter, as shown in FIG. 9F, the movable track 68 is raised and the motors 86 are energized to rotate the table rollers 82 in order to shift the bundle axially through a given distance after which the tieing device is again cycled. This sequence can be repeated as often as is necessary in order to apply a sufficient number of straps to the bundle. Thereafter, the table rollers are driven to axially eject the tied bundle from the carriage assembly. Appropriate delivery tables (not shown) can be positioned to receive the tied bundle. While the tieing operation is taking place, the next bundle is being formed at the bundling and strapping station 14.

The operational sequence of the apparatus when handling shapes such as angles will now be described with reference to FIGS. 10A–10F. In FIG. 10A, the carriage 70 has just been shifted from the bundling and stacking station 14 to the tieing device 58. The elevator units 16 have been raised to their uppermost positions, and the magnets 52 have been properly located in preparation for transferring the first layer of shapes onto the support surfaces 18 of the elevator units. The movable members 38 are in their lowered inoperative positions and they will remain there while shapes are being handled. The conveyor extensions 40 have been lowered, and the hand wheels 110 have been adjusted to open the spacing between the first and second arm members 88, 90. The arm members 90 have also been adjusted to their vertical positions.

As shown in FIG. 10B, the movable track 68 of the tieing device is then lowered and the stack of shapes is tied into an integral unit. Once this has been accomplished, the movable track 68 is raised to its inoperative position and the motors 86 are energized to drive the table rollers 82 in order to relocate the stack for additional strapping, and thereafter to axially eject the fully strapped stack from the carriage assembly 70. While this is taking place, the magnet members continue to cycle between positions **52*a* and 52*b* to transfer successive layers of shapes onto the elevator units 16. The elevator units 16 are gradually lowered to accept successive layers. Periodically, the magnets are cycled between their inoperative positions 52 and the operative positions 52*a* in order to invert a layer of shapes before transferring the same onto the stack being accumulated on the elevator units 16. This periodic inversion of selected layers assists in providing an interlocking relationship thereby improving the structural integrity of the stack. After a strapped stack has been cleared from the carriage assembly 70, the first arm members 88 are lowered to their inoperative positions beneath the level L of the table rollers 82. The second arm members 90** remain in their upstanding positions.

Referring now to FIG. 10D, it will be seen that the carriage assembly 70 is then shifted along tracks 76 back to the bundling and stacking station 14, and as shown in FIG. 10E, thereafter the first arm members 88 are raised to cooperate with the second arm members 90 in confining the completed stack of shapes therebetween. At this point, the level L of the carriage table rollers 82 is above the tips of the lowered movable members 38. Thereafter, as shown in FIG. 10F, the carriage assembly 70 is shifted from the bundling and stacking station 14 back under the tieing device 58 preliminary to the next strapping operation. The entire cycle may then be repeated.

It will thus be seen that the apparatus of the present invention has the capability of handling both rounds and shapes, with most of the components being usable in either operational mode. This results in considerable savings in mill floor space, and also obviates the unnecessary duplication of expensive and complicated components such as the tieing devices 58, the carriage assembly 70, the elevator units 16, etc.

The apparatus is easily converted from one operational mode to another simply by adjusting the positions of selected components such as for example the conveyor extensions 40, movable members 38 and the spacing between the first and second arm members 88, 90.

I claim:

1. A material handling apparatus having a first operational mode for bundling batches of a first type of elongated element with round cross-sectional profiles, and having a second operational mode for stacking batches of a second type of elongated element with shaped flat-sided cross-sectional profiles, said apparatus comprising:

a conveyor means for laterally transporting batches of either of said types of elements in side-by-side relationship to a bundling and stacking station;

a vertically adjustable elevator means at said station for receiving either of said types of elements;

a first transfer means operable during said first operational mode to laterally direct the first type of elongated elements onto said elevator means;

stationary members cooperating with operatively positioned movable members when said apparatus is in said first operational mode to laterally confine the first type of elements into a bundle on said elevator means as said elements are received from said conveyor means, said movable members being adjustable to inoperative positions to accommodate lateral removal of a bundle of said first type of elements from said elevator means and also to convert said apparatus from said first to said second operational mode; and second transfer means operable during the second operational mode of said apparatus for transferring layers of said second type of element from said conveyor means onto said elevator means to form a stack thereon, said second transfer means being adjustable to an inoperative position removed from said conveyor means when converting said apparatus from said second to said first operational mode.

2. The apparatus of claim 1 wherein said second transfer means includes magnet members which are pivotally movable between positions underlying said conveyor means to positions overlying either said conveyor means or said elevator means.

3. The apparatus of claim 2 wherein said second transfer means is operable to invert selected ones of said layers prior to the deposit thereof on said elevator means.

4. The apparatus of claim 1 further comprising tieing means arranged on the side of said bundling and stacking station opposite to that occupied by said conveyor means, and carriage means for laterally transferring either bundles of said first type of elongated elements or stacks of said second type of elongated elements from said bundling and stacking station to said tieing means, said tieing means being operative to tie either said bundles on said stacks into integral units.

5. The apparatus of claim 4 wherein said carriage means defines a support surface at a given level, said elevator means being adjustable to a level beneath said given level when transferring either bundles of said first type of elements or stacks of said second type of elements onto said carriage means.

6. The apparatus of claim 5 wherein said carriage means is further provided with mutually spaced and substantially opposed first and second arm means extending upwardly from said support surface to laterally confine either of said types of elements therebetween on said support surface.

7. The apparatus of claim 6 wherein said first arm means are adjustable to inoperative positions beneath said given level in order to accommodate movement of said carriage means beneath elements being accumulated on said elevator means.

8. The apparatus of claim 5 wherein said support surface is defined by a plurality of rollers, with means for driving said rollers to longitudinally remove either tied bundles of said first type of elements or tied stacks of said second type of elements from said carriage means.

9. The apparatus of claim 6 wherein said support surface is defined by a plurality of first rollers, the confining surfaces of said arm means are defined by a plurality of second rollers, with means for driving said first rollers to longitudinally remove either tied bundles of said first type of elements or tied stacks of said second type of elements from said carriage means.

10. The apparatus of claims 6, 7 or 9 further comprising means for adjusting the spacing between said first and second arm means.

11. The apparatus of claims 6, 7 or 9 further comprising means for adjusting the angular disposition of said first and second arm means in relation to said support surface.

12. A material handling apparatus for bundling a first type of elongated element having round cross-sectional profiles and for stacking a second type of element having flat-sided cross-sectional profiles, said apparatus comprising:

a bundling and stacking station having a vertically adjustable elevator, a conveyor for laterally transporting batches of either of said types of elements to said station, first and second transfer means operable alternatively to respectively transfer individual elements of the first type or layers of elements of the second type onto said elevator to form respectively bundles of the first element type or stacks of the second element type, and means for laterally confining the first type of elements during the accumulation thereof in bundle form on said elevator.

13. An apparatus for bundling a first type of elongated element having round cross-sectional profiles and for stacking a second type of elongated element having shaped flat-sided cross-sectional profiles, comprising:

a conveyor for laterally transporting batches of either type of said elements in side-by-side relationship towards a bundling and stacking station;

a vertically adjustable elevator at said station on which either of said types of elements may be received from said conveyor and accumulated;

stationary members cooperating with adjustable members to laterally confine the first type of elements on said elevator as they are received from the delivery end of said conveyor, said adjustable members being removable to inoperative positions beneath said elevator to permit lateral removal of said first type of element from said elevator and also to adapt the apparatus to handling second elongated elements;

magnet members; and means for pivotally manipulating said magnet members to transfer selected numbers of the second type of elongated element in layers from said conveyor onto said elevator platform, said means being operable to invert selected ones of said layers and further being operable to remove said magnet members to inoperative positions beneath said conveyor.

* * * * *